US008428858B2

(12) United States Patent
Ishikawa et al.

(10) Patent No.: US 8,428,858 B2
(45) Date of Patent: Apr. 23, 2013

(54) TRAFFIC-JAM STATE CALCULATION SYSTEMS, METHODS, AND PROGRAMS

(75) Inventors: Hiroki Ishikawa, Anjo (JP); Junichiro Igawa, Okazaki (JP)

(73) Assignee: Aisin AW Co., Ltd., Anjo (JP)

( * ) Notice: Subject to any disclaimer, the term of this patent is extended or adjusted under 35 U.S.C. 154(b) by 1443 days.

(21) Appl. No.: 12/073,868

(22) Filed: Mar. 11, 2008

(65) Prior Publication Data

US 2008/0234922 A1 Sep. 25, 2008

(30) Foreign Application Priority Data

Mar. 19, 2007 (JP) ..... 2007-070873

(51) Int. Cl.
*G08G 1/01* (2006.01)

(52) U.S. Cl.
USPC ..... 701/119

(58) Field of Classification Search ..... 701/1, 117, 701/118, 119
See application file for complete search history.

(56) References Cited

U.S. PATENT DOCUMENTS

| | | | | |
|---|---|---|---|---|
| 2003/0125874 | A1* | 7/2003 | Fushiki et al. | 701/211 |
| 2005/0143906 | A1* | 6/2005 | Ishikawa et al. | 701/200 |
| 2005/0206534 | A1* | 9/2005 | Yamane et al. | 340/994 |
| 2005/0240340 | A1* | 10/2005 | Ishikawa et al. | 701/117 |
| 2006/0206256 | A1* | 9/2006 | Kumagai et al. | 701/117 |
| 2007/0185643 | A1* | 8/2007 | Yamane et al. | 701/117 |
| 2007/0225894 | A1* | 9/2007 | Tsukamoto | 701/117 |

FOREIGN PATENT DOCUMENTS

| | | |
|---|---|---|
| EP | 1 808 838 A2 | 7/2007 |
| JP | A-2005-209153 | 8/2005 |
| JP | A-2007-183177 | 7/2007 |

OTHER PUBLICATIONS

Nov. 26, 2010 European Search Report issued in EP08 15 2238.
Sep. 15, 2009 Notification of Reasons for Rejection issued in Japanese Patent Application No. 2007-070873.

* cited by examiner

*Primary Examiner* — Thomas Black
*Assistant Examiner* — Ce Li
(74) *Attorney, Agent, or Firm* — Oliff & Berridge, PLC

(57) ABSTRACT

Systems, methods, and programs obtain probe information, the probe information comprising an average speed of probe cars traveling on each of a plurality of links in a predetermined area. The systems, methods, and programs detect, for each of the plurality of links, a first degree of a traffic jam corresponding to the link for each of a plurality of different thresholds by comparing the average speed with each of the thresholds. The systems, methods, and programs obtain traffic-jam information concerning the plurality of links, the obtained traffic information comprising a second degree of the traffic jam corresponding to each of the plurality of links. The systems, methods, and programs compare, for each of the plurality of links, the second degree of the traffic jam with the first degree of the traffic jam for each of the thresholds. The systems, methods, and programs select, for the predetermined area, a threshold from the plurality of thresholds for which the first degree of the traffic jam most matches the second degree of the traffic jam and utilize the selected threshold to determine a severity of the traffic jam for each of the plurality of links.

10 Claims, 9 Drawing Sheets

| SECONDARY-MESH NAME | MESH NUMBER | DETERMINANT | THRESHOLD $V_{31}$(km/h) | | | | | | | MAXIMUM VALUE |
|---|---|---|---|---|---|---|---|---|---|---|
| | | | 3 | 6 | 9 | 12 | 15 | 18 | 21 | 3-21 |
| FUKUOKA | 503033 | WEEKDAY | 10% | 32% | 30% | 21% | 20% | 19% | 18% | 32% |
| NORTHEASTERN OSAKA | 523504 | WEEKDAY | 10% | 32% | 30% | 21% | 20% | 19% | 18% | 32% |
| NORTHERN NAGOYA | 523667 | WEEKDAY | 10% | 32% | 30% | 21% | 20% | 19% | 18% | 32% |
| METROPOLITAN TOKYO | 533946 | WEEKDAY | 20% | 30% | 40% | 38% | 38% | 32% | 31% | 40% |
| NORTHWESTERN SENDAI | 574036 | WEEKDAY | 19% | 27% | 34% | 44% | 44% | 36% | 34% | 44% |
| SAPPORO | 644142 | WEEKDAY | 20% | 30% | 40% | 38% | 38% | 32% | 31% | 40% |
| ... | ... | ... | ... | ... | ... | ... | ... | ... | ... | ... |

FIG. 3

| LINK NUMBER | DATE AND TIME | TIME REQUIRED (sec) | VEHICLE SPEED (km/h) |
|---|---|---|---|
| 1000 | 3/6/2007 14:03:25 | 25 | 15 |
| 1001 | 3/6/2007 14:03:50 | 40 | 8 |
| 1002 | 3/6/2007 14:04:30 | 15 | 35 |
| ... | ... | ... | ... |

FIG. 4

| LINK NUMBER | SEVERITY OF TRAFFIC JAM | ON-LINK TRAVELING TIME (sec) | AVERAGE VEHICLE SPEED (km/h) |
|---|---|---|---|
| 1000 | MODERATE TRAFFIC JAM | 28 | 17 |
| 1001 | SERIOUS TRAFFIC JAM | 38 | 10 |
| 1002 | NO TRAFFIC JAM | 16 | 39 |
| ... | ... | ... | ... |

FIG. 5

| VICS LINK NUMBER | DETAILS |
|---|---|
| 533945-4-4 | SERIOUS TRAFFIC JAM |
| 533946-10-2 | UNDER CONSTRUCTION RESTRICTED VEHICLE ACCESS 13:00-18:00 |
| 533947-6-1 | MODERATE TRAFFIC JAM |
| ... | ... |

FIG. 6

51

| SEVERITY OF TRAFFIC JAM | ROAD ATTRIBUTES | | |
|---|---|---|---|
| | INTER-CITY HIGHWAY | INTRA-CITY HIGHWAY | ORDINARY ROAD |
| SERIOUS TRAFFIC JAM | UNDER 40 km/h | UNDER 20 km/h | UNDER 10 km/h |
| MODERATE TRAFFIC JAM | 40 km/h OR GREATER, AND UNDER 60 km/h | 20 km/h OR GREATER, AND UNDER 40 km/h | 10 km/h OR GREATER, AND UNDER 20 km/h |
| NO TRAFFIC JAM | 60 km/h OR GREATER | 40 km/h OR GREATER | 20 km/h OR GREATER |

FIG. 7

52

| SEVERITY OF TRAFFIC JAM | ROAD ATTRIBUTES | | |
|---|---|---|---|
| | INTER-CITY HIGHWAY | INTRA-CITY HIGHWAY | ORDINARY ROAD |
| SERIOUS TRAFFIC JAM | UNDER $V_{11}$ km/h | UNDER $V_{21}$ km/h | UNDER $V_{31}$ km/h |
| MODERATE TRAFFIC JAM | $V_{11}$ km/h OR GREATER, AND UNDER $V_{12}$ km/h | $V_{21}$ km/h OR GREATER, AND UNDER $V_{22}$ km/h | $V_{31}$ km/h OR GREATER, AND UNDER $V_{32}$ km/h |
| NO TRAFFIC JAM | $V_{12}$ km/h OR GREATER | $V_{22}$ km/h OR GREATER | $V_{32}$ km/h OR GREATER |

FIG. 10A

| SECONDARY-MESH NAME | MESH NUMBER | DETERMINANT | THRESHOLD $V_{31}$(km/h) | | | | | | | MAXIMUM VALUE |
|---|---|---|---|---|---|---|---|---|---|---|
| | | | 3 | 6 | 9 | 12 | 15 | 18 | 21 | 3-21 |
| FUKUOKA | 503033 | WEEKDAY | 10% | 32% | 30% | 21% | 20% | 19% | 18% | 32% |
| NORTHEASTERN OSAKA | 523504 | WEEKDAY | 10% | 32% | 30% | 21% | 20% | 19% | 18% | 32% |
| NORTHERN NAGOYA | 523667 | WEEKDAY | 10% | 32% | 30% | 21% | 20% | 19% | 18% | 32% |
| METROPOLITAN TOKYO | 533946 | WEEKDAY | 20% | 30% | 40% | 38% | 38% | 32% | 31% | 40% |
| NORTHWESTERN SENDAI | 574036 | WEEKDAY | 19% | 27% | 34% | 44% | 44% | 36% | 34% | 44% |
| SAPPORO | 644142 | WEEKDAY | 20% | 30% | 40% | 38% | 38% | 32% | 31% | 40% |
| ... | ... | ... | ... | ... | ... | ... | ... | ... | ... | ... |

FIG. 10B

| SECONDARY-MESH NAME | MESH NUMBER | DETERMINANT | THRESHOLD $V_{31}$(km/h) | | | | | | | MAXIMUM VALUE |
|---|---|---|---|---|---|---|---|---|---|---|
| | | | 3 | 6 | 9 | 12 | 15 | 18 | 21 | 3-21 |
| FUKUOKA | 503033 | WEEKEND/ HOLIDAY | 0% | 33% | 40% | 35% | 42% | 45% | 22% | 45% |
| NORTHEASTERN OSAKA | 523504 | WEEKEND/ HOLIDAY | 0% | 0% | 98% | 40% | 38% | 27% | 25% | 98% |
| NORTHERN NAGOYA | 523667 | WEEKEND/ HOLIDAY | 3% | 3% | 10% | 8% | 6% | 9% | 7% | 10% |
| METROPOLITAN TOKYO | 533946 | WEEKEND/ HOLIDAY | 58% | 33% | 34% | 32% | 26% | 23% | 21% | 58% |
| NORTHWESTERN SENDAI | 574036 | WEEKEND/ HOLIDAY | 0% | 40% | 30% | 26% | 16% | 16% | 19% | 40% |
| SAPPORO | 644142 | WEEKEND/ HOLIDAY | 0% | 20% | 7% | 4% | 4% | 25% | 5% | 25% |
| ... | ... | ... | ... | ... | ... | ... | ... | ... | ... | ... |

TRAFFIC-JAM STATE CALCULATION SYSTEMS, METHODS, AND PROGRAMS

INCORPORATION BY REFERENCE

The disclosure of Japanese Patent Application No. 2007-070873, filed on Mar. 19, 2007, including the specification, drawings, and abstract, is incorporated herein by reference in its entirety.

BACKGROUND

1. Related Technical Fields

Related technical fields include traffic-jam state calculation systems that calculate a traffic-jam state of a link.

2. Related Art

Conventional portable information apparatuses or personal computers are capable of displaying maps of desired areas to users by using map information is stored in memory devices downloaded from servers. The portable information apparatuses include, for example, vehicle-mounted navigation systems, personal digital assistants (PDAs), portable telephones, and the like. The map information includes, for example, names of ordinary roads and highways, and facility names. Such systems not only display maps but may also provide traffic information, such as information concerning traffic jams or the like, in order to improve the convenience. One system that provides such traffic information is the vehicle information communication system (VICS®).

VICS is a system in which sensors provided on roads detect vehicles traveling on the roads, and a VICS center collects the detected data, generates traffic information (VICS information), and provides the VICS information to terminals such as car navigation systems or the like. However, the VICS information can be obtained only from major roads on which the sensors are provided. Thus, there is a problem in that the VICS only covers a limited area.

Thus, a probe-car system has been studied as a new system for obtaining traffic information. In the probe-car system, a traveling vehicle (probe car) is used as a sensor (probe), information measured in the traveling vehicle (probe information) is collected, and traffic information is generated.

Here, the probe-car system has an advantage in that real-time data can be collected from a much wider area compared with the VICS.

In Japanese Unexamined Patent Application Publication No. 2005-209153 (pp. 5-6, Table 2, and FIG. 2), the degree of a traffic jam generated from probe information is included in traffic information provided to users and is used for identifying how severe the traffic jam is. For example, there are three classifications of a traffic jam: a "serious traffic jam," a "moderate traffic jam," and "no traffic jam" listed from the highest degree to the lowest degree.

A link is classified into one of the classifications on the basis of an average speed of vehicles traveling on the link and predetermined thresholds (for example, on an ordinary road, the threshold between a "serious traffic jam" and a "moderate traffic jam" is 12 km/h, and the threshold between a "moderate traffic" and "no traffic jam" is 32 km/h). The degree of a traffic jam into which the link has been classified is provided to the users as traffic information.

SUMMARY

However, in the above system, the traffic information generated from the probe information depends on the amount of probe information (i.e., the percentage of vehicles that function as probe cars). Thus, when the percentage of the vehicles that function as probe cars is low, the traffic information provided by the above system can be unreliable.

For example, a link in which a traffic jam actually does not occur may be determined as a "serious traffic jam," or a link in which a traffic jam actually occurs may be determined as "no traffic jam." In addition, there is a problem in that the traffic information provided from the probe-car system may be different from the VICS information in terms of the degree of a traffic jam in the same zone of a link.

Accordingly, exemplary implementations of the broad principles described herein provide traffic-jam state calculation systems, methods, and programs that can improve the reliability of traffic-jam information provided by a probe-car system Exemplary implementations of the broad principles described herein provide systems, methods, and programs that obtain probe information, the probe information comprising an average speed of probe cars traveling on each of a plurality of links in a predetermined area. The systems, methods, and programs detect, for each of the plurality of links, a first degree of a traffic jam corresponding to the link for each of a plurality of different thresholds by comparing the average speed with each of the thresholds. The systems, methods, and programs obtain traffic-jam information concerning the plurality of links, the obtained traffic information comprising a second degree of the traffic jam corresponding to each plurality of links. The systems, methods, and programs compare, for each of the plurality of links, the second degree of the traffic jam with the first degree of the traffic jam for each of the thresholds. The systems, methods, and programs select, for the predetermined area, a threshold from the plurality of thresholds for which the first degree of the traffic jam most matches the second degree of the traffic jam and utilize the selected threshold to determine a severity of the traffic jam for each of the plurality of links.

BRIEF DESCRIPTION OF THE DRAWINGS

Exemplary implementations will now be described with reference to the accompanying drawings, wherein:

FIG. 3 is a diagram showing an example of probe information stored in a probe-information data base (DB) unit;

FIG. 4 is a diagram showing an example of probe traffic information stored in a traffic-information DB unit;

FIG. 5 is a diagram showing an example of VICS information stored in a VICS-information DB unit;

FIG. 6 is a diagram showing an exemplary degree-of-traffic-jam calculation table used in a VICS center;

FIG. 7 is a diagram showing an exemplary degree-of-traffic-jam calculation table used in a probe center;

FIG. 10A is a diagram showing an example of comparing matching rates corresponding to thresholds on a weekday between a degree of a traffic jam based on probe information and a degree of the traffic jam based on VICS information;

FIG. 10B is a diagram showing an example of comparing matching rates at thresholds over a weekend or on a holiday between a degree of a traffic jam based on probe information and a degree of the traffic jam based on VICS information.

DETAILED DESCRIPTION OF EXEMPLARY IMPLEMENTATIONS

Figure 1:
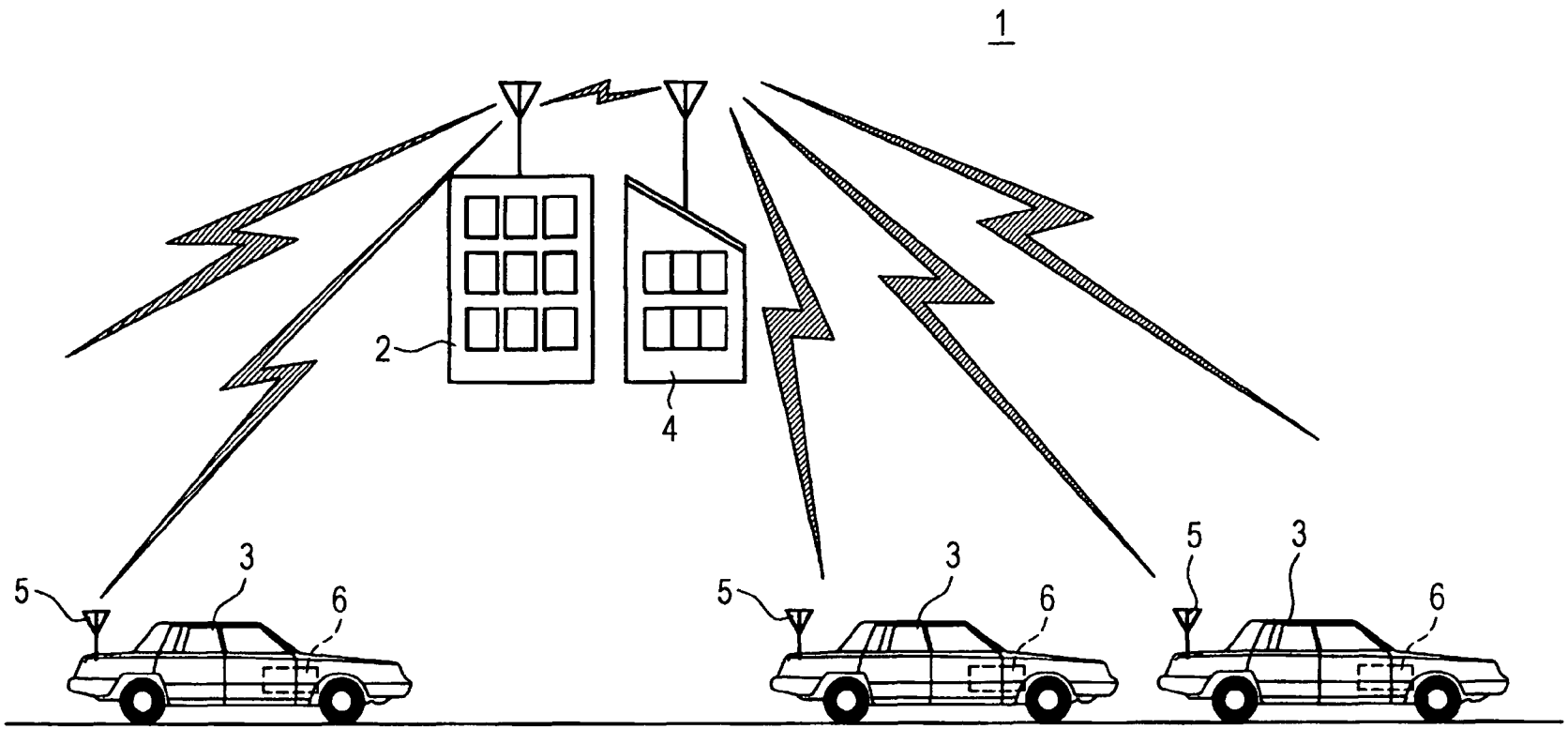
FIG. 1 is a schematic diagram showing an exemplary traffic-jam state calculation system.

An exemplary traffic-jam state calculation system 1 will be described with reference to FIG. 1. As shown in FIG. 1, the traffic-jam state calculation system 1 may include a probe center 2 that collects probe information and which generates and transmits traffic information on the basis of the collected probe information, a probe car (vehicle 3), and a VICS center 4 that generates and transmits VICS information.

The probe center 2 is a traffic-information transmission center that collects and stores probe information sent from a plurality of vehicles 3 traveling nationwide, generates traffic information such as traffic-jam information from the stored probe information, and transmits the generated traffic information (probe traffic information) to the vehicles 3. The probe information may include, for example, a travel path and a travel speed.

The vehicle 3 serving as the probe car and the probe center 2 constitutes a probe-car system. Here, the probe-car system is a system that collects information by using the vehicle 3 as a probe or sensor. The vehicle 3 then transmits data to the probe center 2 via a vehicular communication module 5, such as, for example, a portable telephonic device mounted in the vehicle 3 beforehand. The transmitted data may include speed data, operation-state information concerning vehicle systems (e.g., steering operation and/or gear shift position) and positional information obtained through a Global Positioning System (GPS). The collected data is then used in the probe center 2.

The probe information obtained and transmitted by the vehicle 3 to the probe center 2 may specifically include a link number of a link on which the vehicle 3 is traveling and information concerning the speed of the vehicle 3. The probe center 2 may calculate an average vehicle speed for the link on the basis of the link number and the vehicle speed transmitted from one or more vehicles 3, and may determine the degree of a traffic jam corresponding to the link on the basis of, for example, thresholds $V_{11}$ through $V_{32}$ (see FIG. 7) described below.

A navigation system 6 may be provided in the vehicle 3. The navigation system 6 is a vehicle-mounted system that displays a map around a subject-car position based on stored map data, searches for a route to a set destination, and provides guidance along the route. Moreover, the navigation system 6 may provide the probe traffic information received from the probe center 2 and the VICS information received from the VICS center 4 to a user of the vehicle 3.

The VICS center 4 is an information-providing center that senses vehicles traveling on roads using sensors provided on the roads. The VICS center 4 generates information by sensing the vehicles and receives information provided by certain agencies (e.g., the National Police Agency), and/or the like. Based on such information, the VICS center 4 generates the VICS information, serving as traffic information and provides the generated VICS information to the vehicles 3 via frequency-modulation (FM) multiplex broadcasting, an optical beacon, an electric-wave beacon, and/or the like. The VICS information may include traffic-jam information (e.g., the degree of a traffic jam and the length of a traffic jam). The VICS information may also include restricted-area information, parking-lot information, service-area information, and/or parking-area information.

The probe center 2 and the VICS center 4 may be included in the traffic-jam state calculation system 1. An example of the structure of the probe center 2 and the VICS center 4 will be described with reference to FIG. 2.

Figure 2:
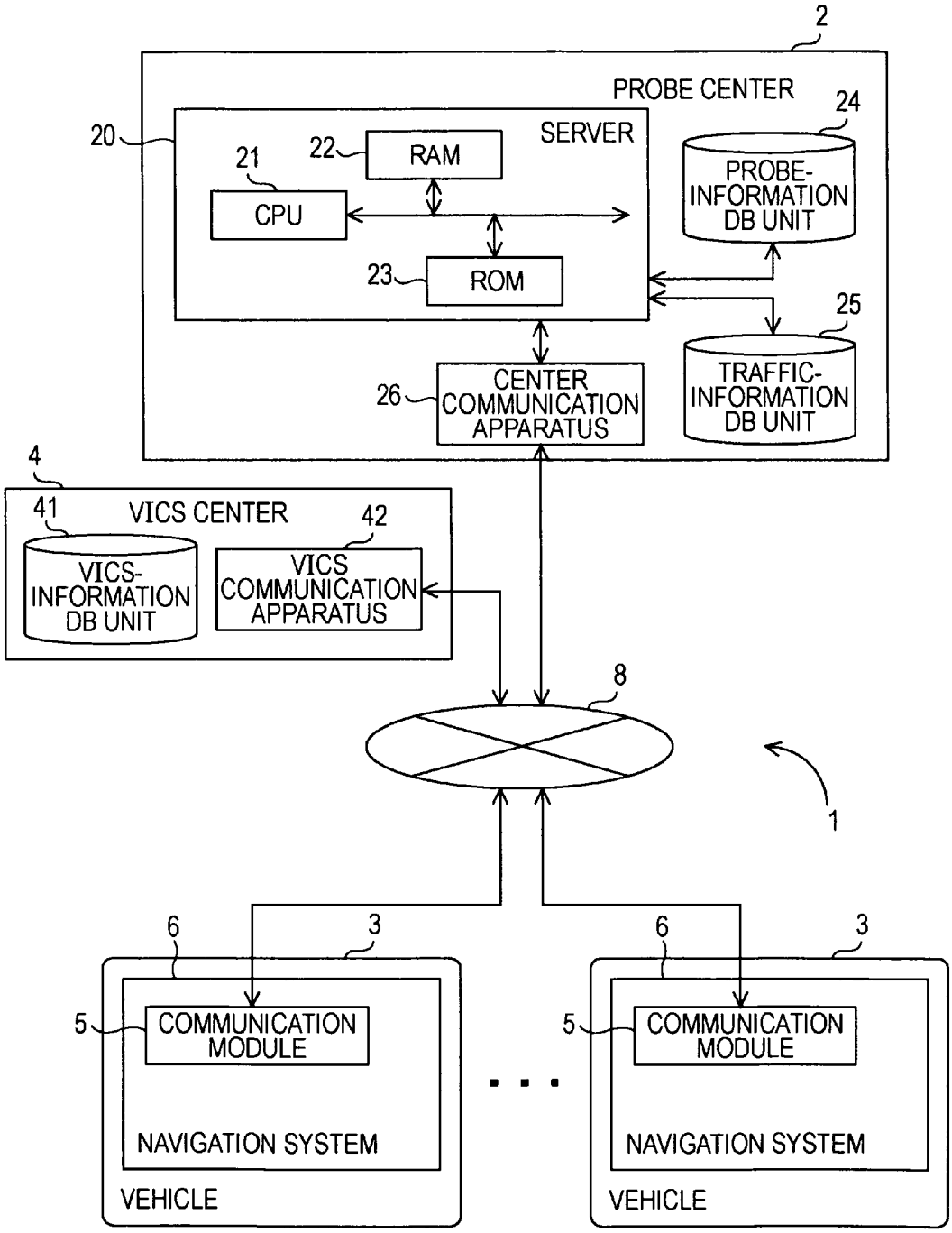
FIG. 2 is a schematic block diagram showing an exemplary structure of the traffic-jam state calculation system.

Referring to FIG. 2, the probe center 2 may include a controller (server 20), a probe-information DB unit 24, a traffic-information DB unit 25, and a center communication apparatus 26. The probe-information DB unit 24 and the traffic-information DB unit 25 may be constituted by one or more memories connected to the server 20.

The server 20 may include a central processing unit (CPU) 21 serving as a calculation apparatus and a control apparatus that controls the server 20. The server 20 may include internal memory apparatuses such as a random-access memory (RAM) 22, a read only memory (ROM) 23, and/or the like. The RAM 22 may be used as a working memory when the CPU 21 performs various calculations. In the ROM 23, various control programs may be stored, such as, for example, a program that implements the degree-of-traffic-jam calculation method (see FIG. 8) and/or other programs for detecting the degree of a traffic jam corresponding to a link by performing statistical processing on probe information collected from the vehicles 3. A program that performs traffic-information transmission processing for generating various traffic information including the degree of the traffic jam corresponding to the link and transmitting the various traffic information to the vehicles 3 may also be stored in the ROM 23.

The probe-information DB unit 24 is a memory in which the probe information collected from the vehicles 3 traveling nationwide may be cumulatively stored. According to this example, the probe information collected from the vehicles 3 may include information concerning link numbers that specify links on which the vehicles 3 have traveled and information concerning the speeds of the vehicles 3 when traveling on the links.

An example of probe information that may be stored in the probe-information DB unit 24 will be described below with reference to FIG. 3. As shown in FIG. 3, the probe information may include the link number of a link on which the vehicle 3 has traveled, the time the vehicle 3 started traveling on the link, the amount of time required to travel the link, and an average speed at which the vehicle 3 traveled the link. For example, the probe information shown in FIG. 3 indicates that the vehicle 3 started traveling on the link having the link number "1000" at 14:03:25 on Mar. 6, 2007, and traveled on the link at an average vehicle speed of 15 km/h for 25 seconds. In the probe-information DB unit 24, such probe information obtained from each of vehicles 3 may be cumulatively stored.

The traffic-information DB unit 25 is a memory in which the probe traffic information generated by the server 20 may be stored. The probe traffic information may be generated by statistically processing the probe information stored in the probe-information DB unit 24. The probe traffic information may include information concerning the degree of a traffic jam corresponding to a link, an on-link traveling time, an average vehicle speed, and/or the like. The degree of a traffic jam is a type of traffic-jam information showing how severe the traffic jam is. For example, there may be four classifications of a traffic jam: a "serious traffic jam," a "moderate traffic jam," "no traffic jam" listed from the highest degree to the lowest degree, and "unknown." The degree of a traffic jam may be determined by the server 20 (as described below) based on the average vehicle speed for a link and the thresholds $V_{11}$ through $V_{32}$ (see FIG. 7). By comparing the VICS information obtained from the VICS center 4 with the statistical results obtained from the probe information, the thresholds $V_{11}$ through $V_{32}$ may be set for each secondary mesh or each prefecture.

An example of the probe traffic information that may be stored in the traffic-information DB unit 25 will be described in more detail with reference to FIG. 4. As shown in FIG. 4, the probe traffic information may include a link number for identifying a link, the degree of a traffic jam, an on-link traveling time representing an average time required for vehicles to travel the link, and/or an average vehicle speed of the vehicles traveling on the link. For example, the probe traffic information shown in FIG. 4 indicates that, in terms of the link having the link number "1000," the degree of a traffic jam indicates that there is a "moderate traffic jam," an on-link traveling time is 28 sec, and the average vehicle speed is 17 km/h. The same number of such pieces of probe traffic information as the links constituting the map data included in the navigation system 6 may be stored in the traffic-information DB unit 25.

The link number used in the probe information and probe traffic information is an identification number used only between the probe center 2 and the navigation system 6 of the vehicle 3, and such link number may be different from a VICS link number, which is used in the VICS center 4 or in the VICS information. Moreover, link coverage concerning the probe information and probe traffic information may be different from that concerning the VICS information.

The center communication apparatus 26 is a communication apparatus for performing communications with the vehicle 3 and the VICS center 4, for example, via a network 8.

Returning to FIG. 2, the VICS center 4 may include a VICS-information DB unit 41 in which the VICS information is stored and a VICS communication apparatus 42. The VICS center 4 may extract necessary information from the VICS information at a predetermined time interval (e.g., every five minutes), and may transmits the extracted information to the navigation system 6 via the VICS communication apparatus 42. The VICS information may also be transmitted to the probe center 2. The VICS information to be transmitted may include the traffic-jam information, restricted-area information, parking-lot information, service-area information, and/or parking-area information.

An example of the VICS information that may be stored in the VICS-information DB unit 41 will be described in detail with reference to FIG. 5. As shown in FIG. 5, the VICS information may include the VICS link number for identifying a link and detailed information having the degree of a traffic jam corresponding to the link, the length of the traffic jam showing a zone of the traffic jam, accident information, construction information, and/or the like. For example, the VICS information shown in FIG. 5 is information generated during the five minutes between 13:56 and 14:01 on Mar. 6, 2007, and transmitted at 14:01 on the same day. The VICS information indicates that, in terms of all zones of the link having the VICS link number "533945-4-4," the degree of a traffic jam corresponding to the link indicates that there is a "serious traffic jam." The VICS information also indicates that, in terms of the link having the VICS link number "533946-10-2," vehicle access is restricted due to construction from 13:00 to 18:00. The VICS information also indicates that, in terms of all zones of the link having the VICS link number "533947-6-1," the degree of a traffic jam corresponding to the link indicates that there is a "moderate traffic jam." Note that if there is a traffic jam occurring only on a part of a link, information concerning the coordinates of the starting point of the traffic jam and information concerning the distance of the zone of the traffic-jam from the starting point may also be included in the VICS information.

The VICS communication apparatus 42 is a communication apparatus for transmitting the VICS information to the vehicles 3 and the probe center 2.

When the traffic information is generated in the probe center 2 and the VICS center 4, degree-of-traffic-jam calculation tables 51 and 52 especially used for detecting the degree of a traffic jam corresponding to a link will be described with reference to FIGS. 6 and 7. FIG. 6 is a diagram showing the degree-of-traffic-jam calculation table 51 used in the VICS center 4. FIG. 7 is a diagram showing the degree-of-traffic-jam calculation table 52 used in the probe center 2.

As shown in FIG. 6, the degree-of-traffic-jam calculation table 51 is a table used for calculating the degree of a traffic jam that shows how severe the traffic jam is on the basis of a vehicle traveling speed. The VICS center 4 detects an average vehicle speed in a predetermined zone on a link based on the detection results obtained by detecting vehicles with sensors provided on roads. The VICS center 4 then determines the degree of a traffic jam corresponding to the predetermined zone based on the average vehicle speed and the degree-of-traffic-jam calculation table 51.

The degree-of-traffic-jam calculation table 51 according to this example includes three classifications of a traffic jam including a "serious traffic jam," a "moderate traffic jam," and "no traffic jam" (in this example, "unknown" is excluded), and thresholds for the vehicle traveling speed corresponding to each of the classifications of a traffic jam. In addition, appropriate values are set as the thresholds for the vehicle traveling speed with respect to each of the following road attributes: an "inter-city highway," an "intra-city highway," and an "ordinary road." In particular, in terms of the "inter-city highway," the threshold between a "serious traffic jam" and a "moderate traffic jam" is 40 km/h, and the threshold between a "moderate traffic jam" and "no traffic jam" is 60 km/h. In terms of the "intra-city highway," the threshold between a "serious traffic jam" and a "moderate traffic jam" is 20 km/h, and the threshold between a "moderate traffic jam" and "no traffic jam" is 40 km/h. In terms of the "ordinary road," the threshold between a "serious traffic jam" and a "moderate traffic jam" is 10 km/h, and the threshold between a "moderate traffic jam" and "no traffic jam" is 20 km/h.

Thus, for example, if vehicles traveling in a zone on an ordinary road at an average speed of 15 km/h are detected by the VICS center 4, the degree of a traffic jam at the zone is determined to be a "moderate traffic jam."

Thus, the VICS center 4 may detects, by using the degree-of-traffic-jam calculation table 51 shown in FIG. 6, the degree of (and length) of a traffic jam for each of the links to which sensors are provided, and may generate the VICS information.

The degree-of-traffic-jam calculation table 52 used in the probe center 2 will be described with reference to FIG. 7. The degree-of-traffic-jam calculation table 52 is a table used for detecting the degree of a traffic jam that indicates how severe the traffic jam is, based on a vehicle traveling speed. By performing statistical processing on the probe information collected from the vehicles 3, the probe center 2 may determine the average vehicle speed for each of the links for every day of the week and for certain times of the day, and may thus determine the degree of a traffic jam corresponding to each of the links on the basis of the degree-of-traffic-jam calculation table 52.

As shown in FIG. 7, the degree-of-traffic-jam calculation table 52 according to this example includes three classifications of a traffic jam including a "serious traffic jam," a "moderate traffic jam," and "no traffic jam," and thresholds for a vehicle speed corresponding to each of the classifications of a traffic jam. As described below, by comparing the VICS data with the statistical results obtained from the probe information, appropriate values are set as the thresholds $V_{11}$ through $V_{32}$ for the vehicle traveling speed with respect to each of the following road attributes: an "inter-city highway," an "intra-city highway," and an "ordinary road." In particular, in terms of the "inter-city highway," the threshold between a "serious traffic jam" and a "moderate traffic jam" is $V_{11}$ km/h, and the threshold between a "moderate traffic jam" and "no traffic jam" is $V_{12}$ km/h. In terms of an "intra-city highway," the threshold between a "serious traffic jam" and a "moderate traffic jam" is $V_{21}$ km/h, and the threshold between a "moderate traffic jam" and "no traffic jam" is $V_{22}$ km/h. In terms of an "ordinary road," the threshold between a "serious traffic jam" and a "moderate traffic jam" is $V_{31}$ km/h, and the threshold between a "moderate traffic jam" and "no traffic jam" is $V_{32}$ km/h.

Appropriate values are set as the thresholds $V_{11}$ through $V_{32}$ with respect to each of the secondary meshes or each of the prefectures.

By using the degree-of-traffic-jam calculation table 52 shown in FIG. 7, the probe center 2 detects the degree of a traffic jam corresponding to each of the links that constitute the map data included in the navigation system 6, and generates the probe traffic information including the degree of a traffic jam corresponding to the detected link.

An exemplary degree-of-traffic-jam calculation method will be described with reference to FIG. 8. The exemplary method may be implemented, for example, by one or more components of the above-described system 1. However, even though the exemplary structure of the above-described system 1 may be referenced in the description, it should be appreciated that the structure is exemplary and the exemplary method need not be limited by any of the above-described exemplary structure.

For example, the method may be executed by the server 20 (in the form of a program) in the probe center 2. The program may be executed after a certain period of time (for example, one year) has passed after the last execution of the program, and may calculate the degree of a traffic jam corresponding to a link on the basis of the probe information collected from probe cars during the certain period of time. The program may be stored in the RAM 22, the ROM 23, and the like included in the server 20, and may be executed by the CPU 21.

Figure 8:
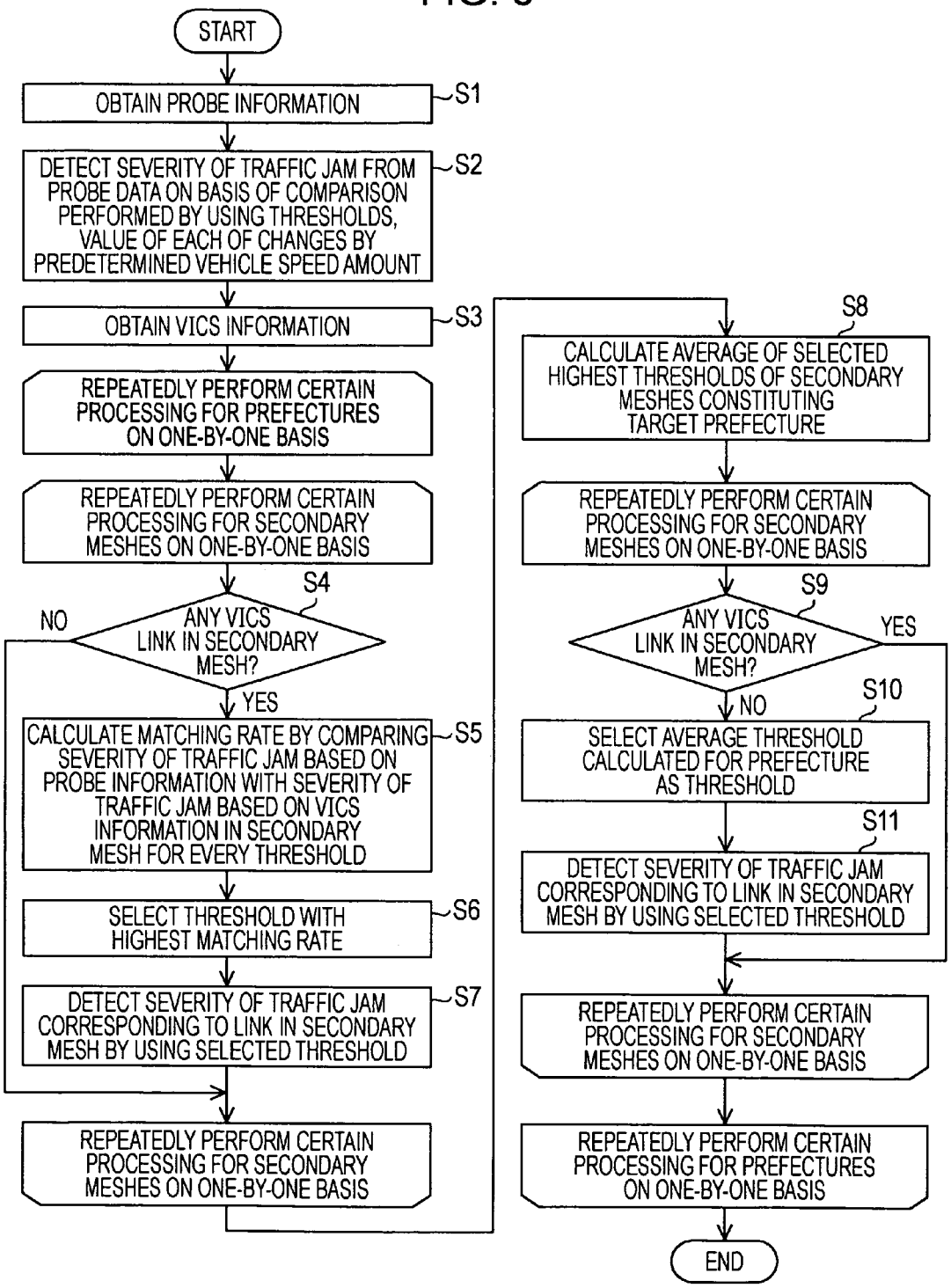
FIG. 8 is a flowchart showing an exemplary degree-of-traffic-jam calculation processing method.

As shown in FIG. 8, in step S1 of the degree-of-traffic-jam calculation processing method, the CPU 21 obtains the probe information (see FIG. 3) from the probe-information DB unit 24. The probe information obtained here is newly obtained from vehicles 3, functioning as probe cars, during a certain period of time within a period of time from the time when the degree-of-traffic-jam calculation processing method was last performed (e.g., one year ago) to the present.

The degree-of-traffic-jam calculation processing program may be executed every time the probe information is newly obtained from a vehicle 3. In this case, the degree of a traffic jam is newly calculated based on the probe information obtained in real time. In step S1, the probe information only for a predetermined period of time in the past may be obtained.

In step S2, the CPU 21 initially performs statistical processing on the probe information obtained in step S1, and particularly calculates an average vehicle speed of vehicles for each of the links on which the vehicles traveled. The degree of a traffic jam (first degree of a traffic jam) for each of the links is detected by comparing the calculated average vehicle speed with a threshold, the value of which changes by a predetermined vehicle speed amount (e.g., every 3 km/h). For example, with respect to the threshold $V_{31}$, the calculated average vehicle speed is compared with seven thresholds such as 3 km/h, 6 km/h, 9 km/h, 12 km/h, 15 km/h, 18 km/h, and 21 km/h.

The processing of step S2 is performed for all the thresholds (six thresholds: $V_{11}$ through $V_{32}$) of the road attributes, and the degree of the traffic jam is detected.

In step S3, with respect to the link concerning the probe information obtained in step S1 from the VICS center 4, the CPU 21 obtains the VICS information (see FIG. 5) concerning the time when the probe information was generated.

In the following, processing of step S4 through step S11 is repeatedly performed for prefectures on one-by-one basis until the processing is finished for all prefectures nationwide. In addition, processing of step S4 through step S7 and that of step S9 through step S11 are repeatedly performed for secondary meshes on one-by-one basis until the processing is finished for all secondary meshes of a prefecture that is a processing target.

In step S4, the CPU 21 determines whether a VICS link (that is, a link in which sensors are provided) exists in the secondary mesh being processed.

If the VICS link is determined to exist (YES in step S4), the flow proceeds to step S5. On the other hand, if the VICS link is determined not to exist (NO in step S4), processing is not performed for the secondary mesh which is the present processing target, and the flow proceeds to the processing for the next secondary mesh.

In step S5, the CPU 21 calculates a matching rate between the degree of a traffic jam (the first degree of a traffic jam) based on the probe information detected in step S2 and the degree of a traffic jam (second degree of a traffic jam) based on the VICS information obtained in step S3 by comparing the first degree of the traffic jam with the second degree of the traffic jam with respect to each of the thresholds.

Figures 9A, 9B:
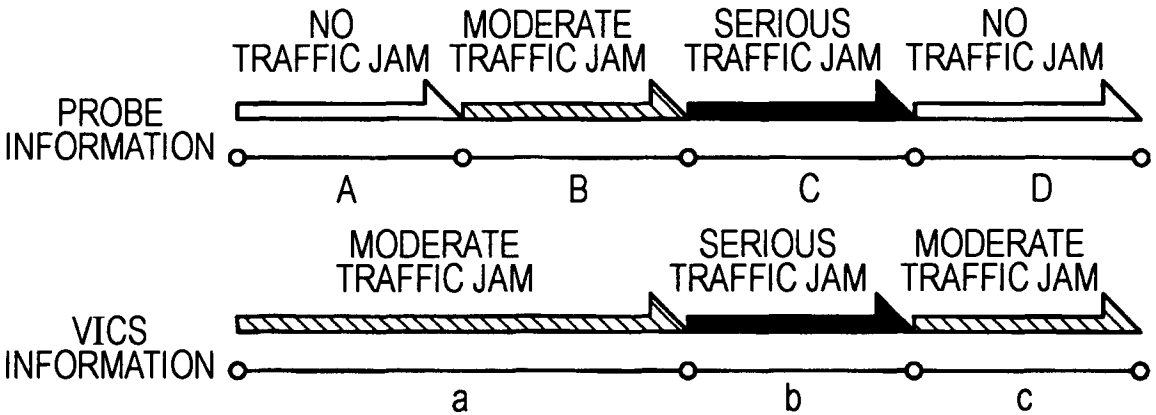
FIGS. 9A and 9B are diagrams showing an example of comparing a degree of a traffic jam based on probe information with a degree of the traffic jam based on VICS information.

FIGS. 9A and 9B are diagrams showing an exemplary comparison between the degree of a traffic jam based on the probe information and the degree of a traffic jam based on the VICS information. As described above, the link coverage used for the probe information and probe traffic information may be different from that used in the VICS center 4 and used for the VICS information. Thus, as shown in FIGS. 9A and 9B, four links A through D constitute a section in the probe information; however, three links a through c may constitute the section in the VICS information.

In the example shown in FIG. 9A, with respect to all zones of the link A, the degree of the traffic jam based on the probe information indicates that there is "no traffic jam," and the degree of the traffic jam based on the VICS information indicates that there is a "moderate traffic jam," and thus the classifications of the traffic jam do not match. With respect to all zones of the link B, the degree of the traffic jam based on the probe information indicates that there is a "moderate traffic jam," and the degree of the traffic jam based on the VICS information indicates that there is a "moderate traffic jam," and thus the classifications of the traffic jam match. With respect to all zones of the link C, the degree of the traffic jam based on the probe information indicates that there is a "serious traffic jam," and the degree of the traffic jam based on the VICS information indicates that there is a "serious traffic jam," and thus the classifications of the traffic jam match. With respect to all zones of the link D, the degree of the traffic jam based on the probe information is "no traffic jam," and the degree of the traffic jam based on the VICS information indicates that there is a "moderate traffic jam," and thus the classifications of the traffic jam do not match.

Thus, the matching rate of the section shown in FIGS. 9A and 9B is 50%. Note that such a matching rate may be calculated based on the proportion of the number of matching links, or may be calculated based on the proportion of the length of a matching section regardless of the links.

The processing of step S5 is performed for each of the plurality of thresholds having different values used in step S2, and a matching rate is calculated for each of the thresholds. In step S6, the CPU 21 selects the threshold whose matching rate calculated in step S5 is the highest among the thresholds having different values.

FIGS. 10A and 10B are diagrams each showing an exemplary comparison of the matching rates, at thresholds, between the degree of a traffic jam based on the probe information and the degree of a traffic jam based on the VICS information. Note that FIGS. 10A and 10B each show an exemplary comparison with respect to the threshold $V_{31}$ that is used to differentiate a "moderate traffic jam" from "no traffic jam" on an "ordinary road." Such comparison is performed at seven thresholds: 3 km/h, 6 km/h, 9 km/h, 12 km/h, 15 km/h, 18 km/h, and 21 km/h.

On a weekday, as shown in FIG. 10A, with respect to secondary meshes in "Fukuoka," "northeastern Osaka," and "northern Nagoya," when the threshold $V_{31}$=6 km/h, the highest matching rate is obtained. Thus, 6 km/h is selected as the threshold $V_{31}$ for the secondary meshes in "Fukuoka," "northeastern Osaka," and "northern Nagoya." With respect to secondary meshes in "metropolitan Tokyo" and "Sapporo," when the threshold $V_{31}$=9 km/h, the highest matching rate is obtained. Thus, 9 km/h is selected as the threshold $V_{31}$ for the secondary meshes in "metropolitan Tokyo" and "Sapporo." With respect to a secondary mesh in "northwestern Sendai," when the threshold $V_{31}$=12 km/h, the highest matching rate is obtained. Thus, 12 km/h is selected as the threshold $V_{31}$ for the secondary mesh in "northwestern Sendai."

Over a weekend or on a holiday, as shown in FIG. 10B, with respect to a secondary mesh in "metropolitan Tokyo," when the threshold $V_{31}$=3 km/h, the highest matching rate is obtained. Thus, 3 km/h is selected as the threshold $V_{31}$ for the secondary mesh in "metropolitan Tokyo." With respect to a secondary mesh in "northwestern Sendai," when the threshold $V_{31}$=6 km/h, the highest matching rate is obtained. Thus, 6 km/h is selected as the threshold $V_{31}$ for the secondary mesh in "northwestern Sendai." With respect to secondary meshes in "northeastern Osaka" and "northern Nagoya," when the threshold $V_{31}$=9 km/h, the highest matching rate is obtained. Thus, 9 km/h is selected as the threshold $V_{31}$ for the secondary meshes in "northeastern Osaka" and "northern Nagoya." With respect to secondary meshes in "Fukuoka" and "Sapporo," when the threshold $V_{31}$=18 km/h, the highest matching rate is obtained. Thus, 18 km/h is selected as the threshold $V_{31}$ for the secondary meshes in "Fukuoka" and "Sapporo."

The processing of steps S5 and S6 is performed for all thresholds (six thresholds: $V_{11}$ through $V_{32}$) of the road attributes. In step S7, the CPU 21 detects the degree of a traffic jam corresponding to each of the links in the secondary mesh which is the present processing target, by using the degree-of-traffic-jam calculation table 52 (FIG. 7) including the thresholds selected in step S6. Note that the processing of step S7 may employ the detection result of the degree of the traffic jam based on each of the thresholds selected in step S6 among the detection results obtained in step S2 without any further processing.

Afterwards, when the processing of step S4 through step S7 is finished on all the secondary meshes of the prefecture which is the present processing target, in step S8, the CPU 21 reads the highest thresholds selected in step S6 with respect to the secondary meshes constituting the prefecture which is the present processing target, and calculates an average of the highest thresholds selected in step S6.

In step S9, the CPU 21 determines whether a VICS link exists in the secondary mesh that is the present processing target. If the VICS link is determined not to exist (NO in step S9), the flow proceeds to step S10. On the other hand, if the VICS link is determined to exist (YES in step S9), processing is not performed for the secondary mesh which is the present processing target, and the flow proceeds to the processing for the next secondary mesh.

In step S10, the CPU 21 sets the average of the thresholds, obtained in step S8, of the secondary meshes constituting the prefecture which is the present processing target, as the threshold of a secondary mesh which is the present processing target and is determined not to have any VICS link.

Figure 11:
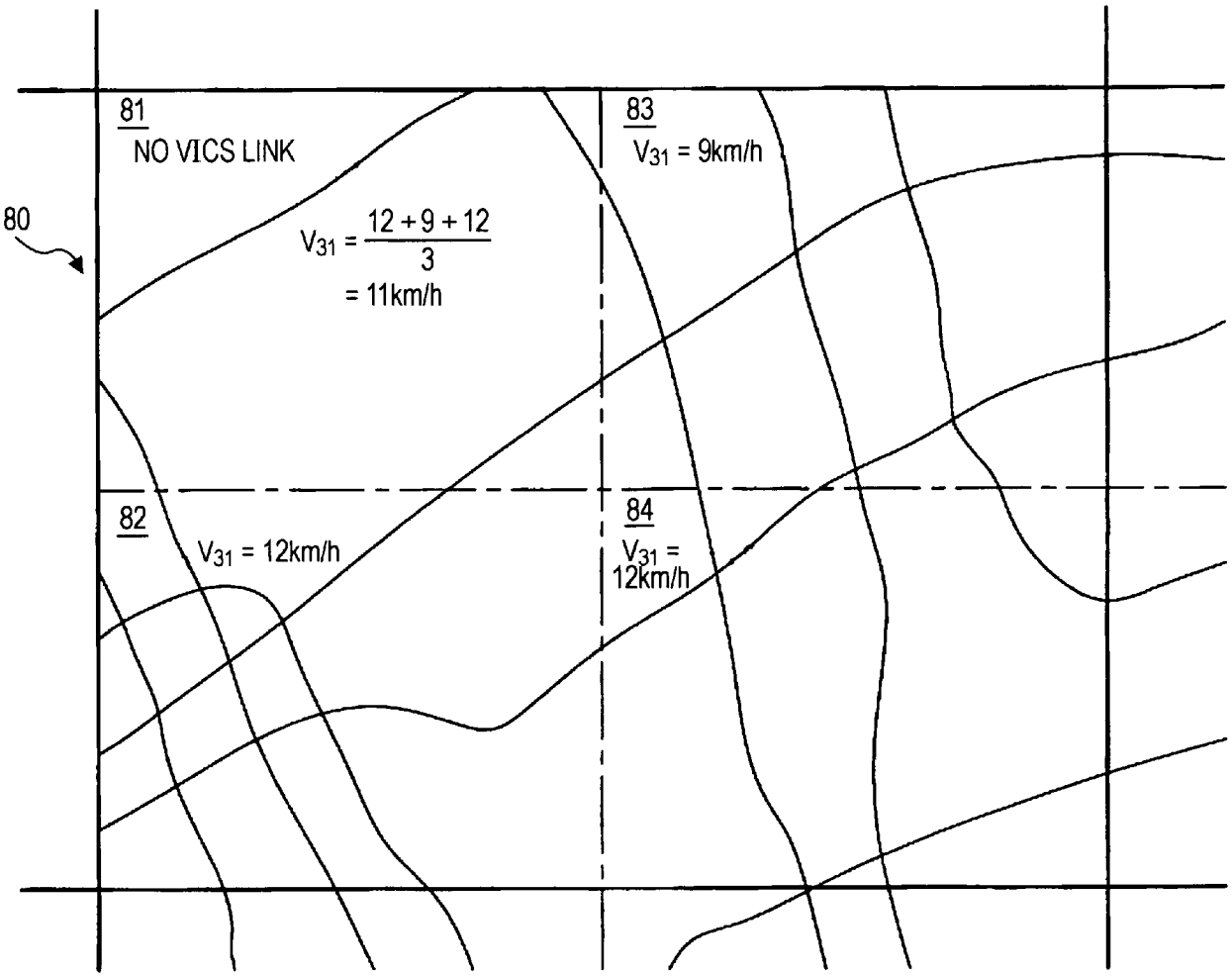
FIG. 11 is a diagram showing an example of selecting a threshold for a secondary mesh in which a VICS link is determined not to exist.

FIG. 11 is a diagram for describing exemplary processing for selecting a threshold of a secondary mesh that is determined not to have any VICS link. In FIG. 11, a prefectural area 80 includes four secondary meshes 81 through 84.

No VICS link exists in the secondary mesh 81. A VICS link exists in each of the secondary meshes 82 through 84, and the thresholds $V_{31}$ for the secondary meshes 82 through 84 are selected to be 12 km/h, 9 km/h, and 12 km/h, respectively, in the processing of step S6. (Descriptions are omitted with respect to the thresholds $V_{11}$ through $V_{22}$ and $V_{32}$.) In this case, the threshold of the secondary mesh 81 is the average of the thresholds for the secondary meshes 82 through 84 within the same prefecture, thereby the threshold $V_{31}$=(12+9+12)/3=11 km/h.

The processing in step S10 is performed for all the thresholds (six thresholds: $V_{11}$ through $V_{32}$) of the road attributes.

In step S11, the CPU 21 detects the degree of a traffic jam corresponding to each of the links in the secondary mesh which is the present processing target, by using the degree-of-traffic-jam calculation table 52 (FIG. 7) including the thresholds selected in step S10.

Afterwards, when the processing of step S9 through step S11 is finished for all the secondary meshes of the prefecture which is the processing target, the flow proceeds to the processing for the next prefecture. After the processing is performed for all the prefectures nationwide, the degree-of-traffic-jam calculation processing method is finished.

Information concerning the degree of a traffic jam corresponding to each of the links calculated in the degree-of-traffic-jam calculation processing program is transmitted as the probe traffic information to the navigation system 6 in the vehicle 3. The navigation system 6 may thus provide information on the traffic-jam state or search for the best route by using the transmitted information concerning the degree of the traffic jam corresponding to each of the links. Moreover, if the degree of a traffic jam detected based on the statistical processing result of the probe information is different from the degree of the traffic jam based on the VICS information in the same zone of a link, the degree of the traffic jam based on the VICS information is preferentially displayed.

As described in detail above, in the traffic-jam state calculation system 1 according to the above example, when the degree of a traffic jam corresponding to a link is calculated on the basis of the probe information collected from the vehicles 3 functioning as probe cars, the degree of the traffic jam is detected by using the thresholds $V_{11}$ through $V_{32}$, the value of each of which changes by a predetermined vehicle speed amount and which are used to identify the degree of the traffic jam included in the degree-of-traffic-jam calculation table 52

(step S2). The thresholds $V_{11}$ through $V_{32}$ are selected to have the highest matching rate by comparing the degree of the traffic jam based on the probe information with the degree of the traffic jam based on the VICS information for the secondary meshes on one-by-one basis (steps S5 and S6). The degree of the traffic jam corresponding to each of the secondary meshes is detected based on the selected thresholds $V_{11}$ through $V_{32}$ for the secondary mesh (step S7). Therefore, the reliability of the traffic-jam information provided by such a probe car system is improved by considering the VICS information.

Since a large difference between the degree of a traffic jam corresponding to the link on the basis of the probe information, and the degree of the traffic jam corresponding to the link and based on the VICS information can be prevented, users are not confused with the traffic information provided.

Furthermore, because appropriate values are selected as the thresholds with respect to each of the road attributes, more appropriate thresholds can be selected for each of the links by considering the road attributes of the link. Therefore, the reliability of the traffic-jam information provided by the probe car system can be improved.

The thresholds are selected in order to be matched with the VICS information with high reliability provided by the VICS. Thus, the reliability of the traffic-jam information provided by the probe car system can be improved.

Such thresholds are selected for each of secondary meshes or each of prefectures. Therefore, thresholds appropriate for an every region can be selected by considering regional differences.

With respect to a secondary mesh with no VICS link, an average of the thresholds corresponding to other areas in a target prefecture including the secondary mesh with no VICS link is selected as the threshold for the secondary mesh with no VICS link (step S10). Thus, even if no VICS information is obtained as a comparison target, a threshold appropriate for the secondary mesh with no VICS link can be selected by considering the thresholds for its neighboring areas.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

For example, in the above example, the probe center 2 performs threshold selection processing based on comparison results with respect to the degree of a traffic jam and performs the degree-of-traffic-jam detection processing based on the selected thresholds (step S4 through step S11). However, both types of processing may be performed by the VICS center 4 or the navigation system 6. Alternatively, both types of processing may be performed by a predetermined combination of the probe center 2, the VICS center 4, and the navigation system 6. For example, the probe center 2 may perform the threshold selection processing based on comparison results with respect to the degree of a traffic jam, and the navigation system 6 may perform the degree-of-traffic-jam detection processing based on the selected thresholds.

In the above examples, the degree of a traffic jam based on the statistical results about the probe information (the first degree of a traffic jam) is compared with the degree of the traffic jam based on the VICS information (the second degree of the traffic jam) for secondary meshes on one-by-one basis. However, such comparison may be performed for prefectures on one-by-one basis. In this case, thresholds $V_{11}$ through $V_{32}$ may be selected for each of the prefecture.

Furthermore, in the above examples, with respect to a certain threshold corresponding to a secondary mesh with no VICS link, the average of the thresholds for other areas in a target prefecture including the secondary mesh with no VICS link is selected as the threshold for the secondary mesh with no VICS link. However, for example, a median threshold instead of the average threshold may be selected as the threshold for the secondary mesh with no VICS link. A threshold identical to the threshold of an adjacent secondary mesh may be employed as the threshold for the secondary mesh with no VICS link. The average of the thresholds for adjacent secondary meshes may be employed as the threshold of the secondary mesh with no VICS link.

The VICS information shown in FIG. 6 is an example in which the same degree of a traffic jam is obtained in all zones in a link. However, the above principles may be applied to a case in which only some zones in the link indicate that there is a "serious traffic jam" or a "moderate traffic jam," or a case in which a plurality of classifications of a traffic jam exist in the same link. In such a case, it is desirable to calculate a matching rate by comparing the degree of a traffic jam based on the probe information with the degree of the traffic jam based on the VICS information not for each link but in terms of distance. Between the classifications (a "serious traffic jam," a "moderate traffic jam," and "no traffic jam") of a traffic jam set for a link, the degree of the traffic jam with the highest proportion in terms of distance may be assumed to be the degree of the traffic jam corresponding to the link, and comparison processing may be performed for each of the links.

What is claimed is:

1. A traffic jam state calculation system comprising:

a controller that:

obtains probe information, the probe information comprising an average speed of probe cars traveling on each of a plurality of links in a predetermined area;

compares the average speed of each of the plurality of links with each of a plurality of thresholds, each of the plurality of thresholds having a different value;

based on the comparison, detects, for each of the plurality of links, a first degree of a traffic jam corresponding to the link for each of the plurality of different thresholds;

obtains traffic jam information concerning the plurality of links, the obtained traffic information comprising a second degree of the traffic jam corresponding to each of the plurality of links;

compares, for each of the plurality of links, the second degree of the traffic jam with the first degree of the traffic jam for each of the thresholds;

selects, for the predetermined area, a threshold from the plurality of thresholds for which the first degree of the traffic jam most matches the second degree of the traffic jam, the threshold usable to differentiate a degree of the traffic jam in the predetermined area; and utilizes the selected threshold to determine a severity of the traffic jam for each of the plurality of links.

2. The traffic jam state calculation system according to claim 1, wherein the controller:

determines the severity of the traffic jam for each of the plurality of links by comparing the average speed of probe cars traveling on each link with the selected threshold.

3. The traffic jam state calculation system according to claim 1, wherein the controller:

selects a plurality of thresholds for the predetermined area, each of the selected thresholds respectively corresponding to each of a plurality of road attributes.

4. The traffic jam state calculation system according to claim 1, wherein the obtained traffic jam information is information that is based on the sensing of a vehicle by a stationary sensor located on a road.

5. The traffic jam state calculation system according to claim 1 wherein the predetermined area is at least one of:

one of a plurality of meshes; and one of a plurality of prefectures.

6. The traffic jam state calculation system according to claim 1, wherein the controller:

applies, as a threshold of an area within a prefecture for which no traffic jam information can be obtained, an average of thresholds of areas in the prefecture in which traffic jam information was obtained.

7. The traffic jam state calculation system according to claim 1, wherein the controller:

applies, as a threshold of an area within a prefecture for which no traffic-jam information can be obtained, a median of thresholds of areas in the prefecture in which traffic jam information was obtained.

8. The traffic jam state calculation system according to claim 1, wherein the controller:

applies, as a threshold of an area within a prefecture in which no traffic jam information can be obtained, a threshold of an area adjacent to the area for which no traffic-jam information can be obtained.

9. The traffic jam state calculation system according to claim 1, further comprising:

a communication apparatus that transmits the determined severity of the traffic jam for each of the plurality of links to a navigation system in a vehicle.

10. The traffic jam state calculation system according to claim 1, further comprising:

a communication apparatus that receives the probe information from a navigation system in a vehicle.

* * * * *